US008567000B2

(12) United States Patent
Kubo

(10) Patent No.: US 8,567,000 B2
(45) Date of Patent: Oct. 29, 2013

(54) INTERDENTAL BRUSH AND METHOD OF PRODUCING THE SAME

(75) Inventor: Yosuke Kubo, Izumisano (JP)

(73) Assignee: Kabushiki Kaisha UFC Supply, Osaka (JP)

( * ) Notice: Subject to any disclaimer, the term of this patent is extended or adjusted under 35 U.S.C. 154(b) by 208 days.

(21) Appl. No.: 13/255,173

(22) PCT Filed: Nov. 5, 2009

(86) PCT No.: PCT/JP2009/005876
§ 371 (c)(1),
(2), (4) Date: Sep. 7, 2011

(87) PCT Pub. No.: WO2011/001480
PCT Pub. Date: Jan. 6, 2011

(65) Prior Publication Data

US 2011/0314624 A1 Dec. 29, 2011

(30) Foreign Application Priority Data

Jul. 2, 2009 (JP) ..... 2009-158052

(51) Int. Cl.
*A46B 3/18* (2006.01)
*A61C 15/00* (2006.01)

(52) U.S. Cl.
USPC ..... 15/206; 15/143.1; 15/167.1; 132/321; 300/21; 433/141

(58) Field of Classification Search
USPC ..... 15/143.1, 167.1, 206; 132/321, 328, 132/329; 433/141, 142; 300/21
See application file for complete search history.

(56) References Cited

U.S. PATENT DOCUMENTS

2006/0179593 A1 8/2006 Okamura
2007/0226932 A1 10/2007 Huang et al.

FOREIGN PATENT DOCUMENTS

DE 10354774 * 6/2005
JP 62-174423 U 11/1987
JP 10-155546 A 6/1998
JP 2004-344229 A 12/2004
JP 3886050 B2 2/2007
JP 2007-260406 A 10/2007

OTHER PUBLICATIONS

International Search Report for PCT/JP2009/005876, dated Dec. 15, 2009.
Notification of Transmittal of Translation of the International Preliminary Report on Patentability (Form PCT/IB/338) of International Application No. PCT/JP2009/005876 mailed Feb. 23, 2012 with Forms PCT/IB/373, PCT/ISA/237, PCT/IB/326 and PCT/IB/308.

* cited by examiner

*Primary Examiner* — Mark Spisich
(74) *Attorney, Agent, or Firm* — Westerman, Hattori, Daniels & Adrian, LLP

(57) ABSTRACT

An interdental brush of the present invention includes bristles (11), a wire (12) twisted with the bristles (11), and a handle (20) attached to the wire (12). The handle (20) includes a main body (21). The main body (21) is formed with a longitudinal hole (41) through which a base part of the wire (12) extends, a space section (42) connecting to the longitudinal hole (41), and extending through the main body (21) in a lateral direction, and a tubular wire detachment preventing portion (50) extending from a peripheral portion of an opening of the longitudinal hole (41) at an inner wall surface of the space section (42) into the space section (42). The wire detachment preventing portion (50) is curved together with the wire (12) with a tip portion of the base part of the wire (12) being inserted therein.

10 Claims, 13 Drawing Sheets

INTERDENTAL BRUSH AND METHOD OF PRODUCING THE SAME

TECHNICAL FIELD

The present invention relates to an interdental brush and a method of producing the same.

BACKGROUND ART

As a type of an interdental brush, there is known one which includes bristles, a wire twisted with the bristles, and a handle attached to the wire, wherein a detachment preventing curved portion is formed at the base part of the wire, and the attachment of the wire to the handle is carried out by insert resin molding thereof (see, e.g., Patent Document 1).

Insert resin molding is high in equipment cost due to the structure of a molding die which is complicated and expensive. In addition, the operation of setting a wire to the die needs time and labor, and is therefore troublesome. Accordingly, an internal brush produced by insert resin molding is expensive. In view of this, the present applicant has developed an interdental brush and a method of producing the same which allow the interdental brush to be produced by simple resin molding without using insert resin molding (see Patent Document 2).

PRIOR ART LITERATURES

Patent Literatures

Patent Literature 1: Japanese Unexamined Utility Model Publication No. SHO 62-174423

Patent Literature 2: Japanese Patent No. 3886050

SUMMARY OF INVENTION

Technical Problem

An object of the present invention is to provide an inexpensive interdental brush in which a wire is less likely to come off a handle, and a producing method which allows the production thereof.

Solution to Problem

According to an inventive aspect of claim 1, there is provided an interdental brush including: bristles (11); a wire (12) twisted with the bristles (11); and a handle (20) attached to the wire (12), the handle (20) including a main body (21), wherein the main body (21) is formed with a longitudinal hole (41) through which a base part of the wire (12) extends, a space section (42) connecting to the longitudinal hole (41), and extending through the main body (21) in a lateral direction, and a tubular wire detachment preventing portion (50) extending from a peripheral portion of an opening of the longitudinal hole (41) at an inner wall surface of the space section (42) into the space section (42), and the wire detachment preventing portion (50) is curved together with the wire (12) with a tip portion of the base part of the wire (12) being inserted therein.

The inventive aspect of claim 1 allows the interdental brush to be produced by simple resin molding without using insert resin molding. Therefore, an inexpensive interdental brush is provided. In the inventive aspect of claim 1, the main body (21) is formed with the wire detachment preventing portion (50), and the wire detachment preventing portion (50) is curved together with the wire (12) with the tip portion of the base part of the wire (12) being inserted therein. As a result, the wire (12) is less likely to come off the longitudinal hole (41) formed in the main body (21). In other words, the wire (12) is less likely to come off the handle (20). As compared to the case where the main body (21) does not have the wire detachment preventing portion (50), and only the tip portion of the base part of the wire (12) is curved, the wire (12) is less likely to rotate in the longitudinal hole (41) in the inventive aspect of claim 1. In addition, when the wire (12) is pulled, the wire (12) is less likely to be straightened into a linear shape. Therefore, the wire (12) is less likely to come off the longitudinal hole (41).

According to an inventive aspect of claim 2, there is provided the interdental brush according to the inventive aspect of claim 1, wherein the space section (42) is filled with a filler member (22), and the filler member (22) forms an engagement portion (52) surrounding the periphery of the wire detachment preventing portion (50). In the structure, the filler member (22) filling the space section (42) forms the engagement portion (52) surrounding the periphery of the wire detachment preventing portion (50). As a result, the wire (12) is less likely to rotate in the longitudinal hole (41) and, when the wire (12) is pulled, the wire (12) is less likely to be straightened into a linear shape. Therefore, the wire (12) is less likely to come off the longitudinal hole (41).

According to an inventive aspect of claim 3, there is provided the interdental brush according to the inventive aspect of claim 1, wherein the handle (20) includes the main body (21) and a sub-body (22), and the sub-body (22) includes an engagement portion (52) filling the space section (42) so as to surround the periphery of the wire detachment preventing portion (50). In the structure, the sub-body (22) includes the engagement portion (52) filling the space section (42) so as to surround the periphery of the wire detachment preventing portion (50). As a result, the same effect as obtained in accordance with the inventive aspect of claim 2 is obtainable.

According to an inventive aspect of claim 4, there is provided the interdental brush according to the inventive aspect of claim 3, wherein a part of a surface of the main body (21) is covered with the sub-body (22), and the main body (21) and the sub-body (22) have respective discrimination properties different from each other. The structure can add a visual appeal.

According to an inventive aspect of claim 5, there is provided the interdental brush according to the inventive aspect of claim 3, wherein the main body (21) and the sub-body (22) are each made of a synthetic resin. In the structure, the fitting property between the resins is high, and therefore it is possible to enhance the bonding strength between the main body and the sub-body.

According to an inventive aspect of claim 6, there is provided the interdental brush according to the inventive aspect of claim 4, wherein the difference between the discrimination properties results from at least any one of color, gloss, and material. The structure allows easy change of the different discrimination properties.

According to an inventive aspect of claim 7, there is provided the interdental brush according to any one of the inventive aspects of claims 3 to 6, wherein the main body (21) includes a shoulder portion (32), a tail portion (34), and a trunk portion (33) communicating the shoulder portion (32) to the tail portion (34) via a step at a low level, the space section (42) is formed between the shoulder portion (32) and the trunk portion (33), the sub-body (22) fills the space section (42), and covers the trunk portion (33), and the boundaries between respective surfaces of the shoulder portion (32)

and the tail portion (34) and a surface of the sub-body (22) adjacent thereto are flush with each other. In the structure, it is possible to provide the entire handle with a flat and smooth image, and contribute to improving the merchantability.

According to an inventive aspect of claim 8, there is provided a method of producing an interdental brush including a wire (12) twisted with bristles (11), and a handle (20) attached to the wire (12), the handle (20) including a main body (21), the method including the steps of: resin molding the main body (21) including a longitudinal hole (41), a space section (42) connecting to the longitudinal hole (41), and extending through the main body (21) in a lateral direction, and a tubular part (50*a*) extending from a peripheral portion of an opening of the longitudinal hole (41) at an inner wall surface of the space section (42) into the space section (42); and inserting a tip portion of a base part of the wire (12) into the tubular part (50*a*) through the longitudinal hole (41) of the main body (21), and curving the tubular part (50*a*) together with the wire (12) with the tip portion of the base part of the wire (12) being inserted in the tubular part (50*a*) to form a wire detachment preventing portion (50) in the main body (21).

The inventive aspect of claim 8 allows the bristles, the wire, and the handle to be produced in mutually different steps, and allows the interdental brush to be produced by a simple process. Accordingly, the production cost of the interdental brush is satisfactorily low.

According to an inventive aspect of claim 9, there is provided the method of producing the interdental brush according to the inventive aspect of claim 8, further including the step of: resin molding a sub-body (22) of the handle (20) so as to cause a part of the sub-body (22) to surround the periphery of the wire detachment preventing portion (50), and fill the space section (42). In the structure, it is possible to cause a part of the sub-body (22) to fill the space section (42) so as to surround the periphery of the wire detachment preventing portion (50).

According to an inventive aspect of claim 10, there is provided the method of producing the interdental brush according to any one of the inventive aspects of claims 8 and 9, wherein the formation of the wire detachment preventing portion (50) is performed by pressing, using two jigs, the tubular part (50*a*) in which the base part of the wire (12) is inserted from both sides thereof in a nipping manner through the space section (42). In the structure, by curving the tubular part (50*a*) using the two jigs, the wire detachment preventing portion (50) can be formed.

Advantageous Effects of Invention

According to the invention, there are provided an inexpensive interdental brush in which a wire is less likely to come off a handle, and a producing method which allows the production thereof.

DESCRIPTION OF EMBODIMENTS

Figure 1:
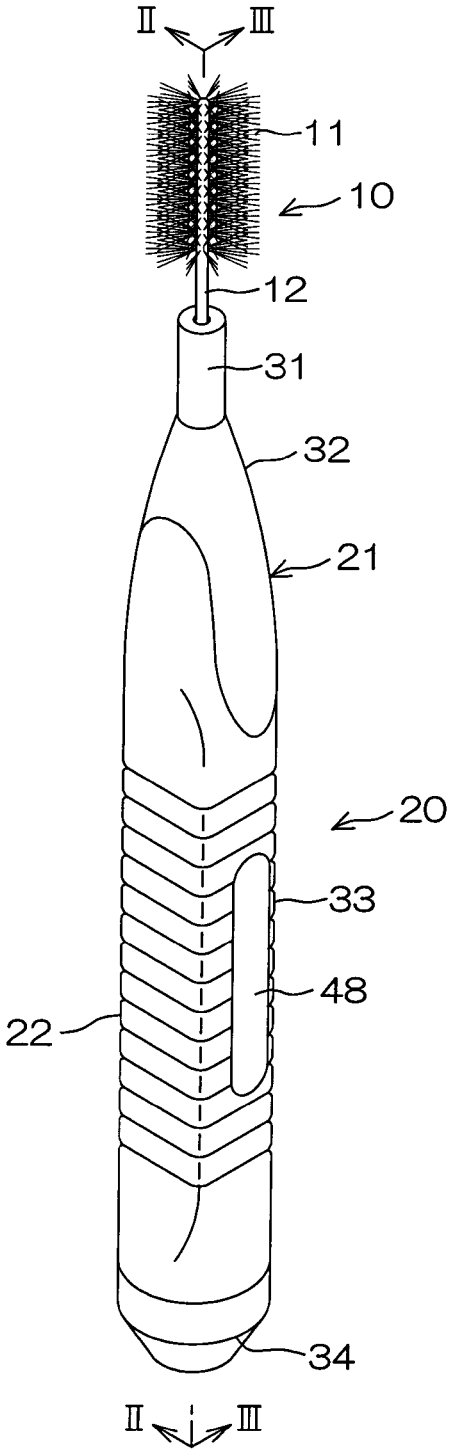
FIG. 1 is a perspective view of an interdental brush according to a first embodiment of the present invention.

Referring now to the drawings, the embodiments of the present invention are described below.

EXAMPLES (1) Embodiment 1

Figure 2:
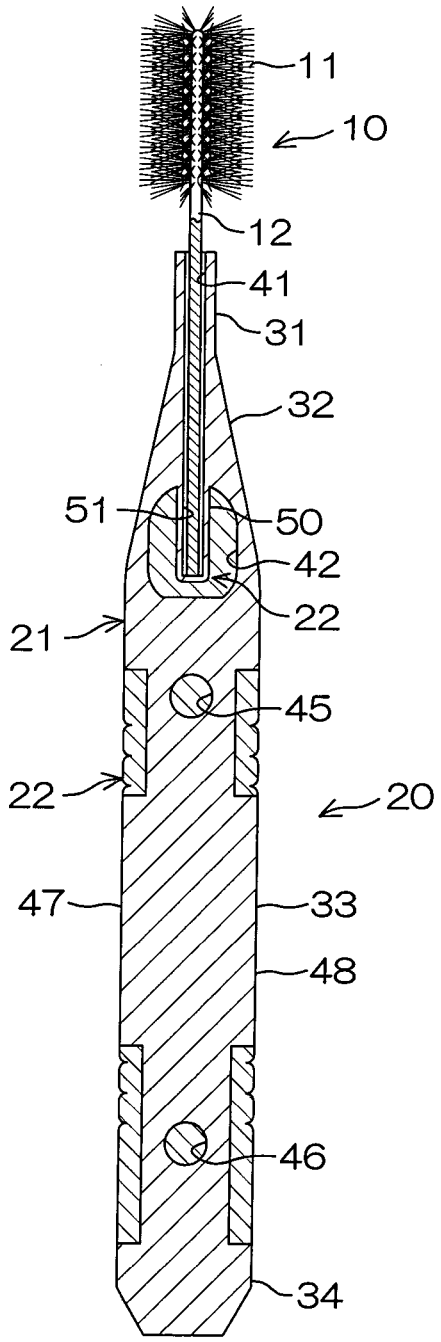
FIG. 2 is a vertical cross-sectional view along the line II-II of FIG. 1.
Figure 3:
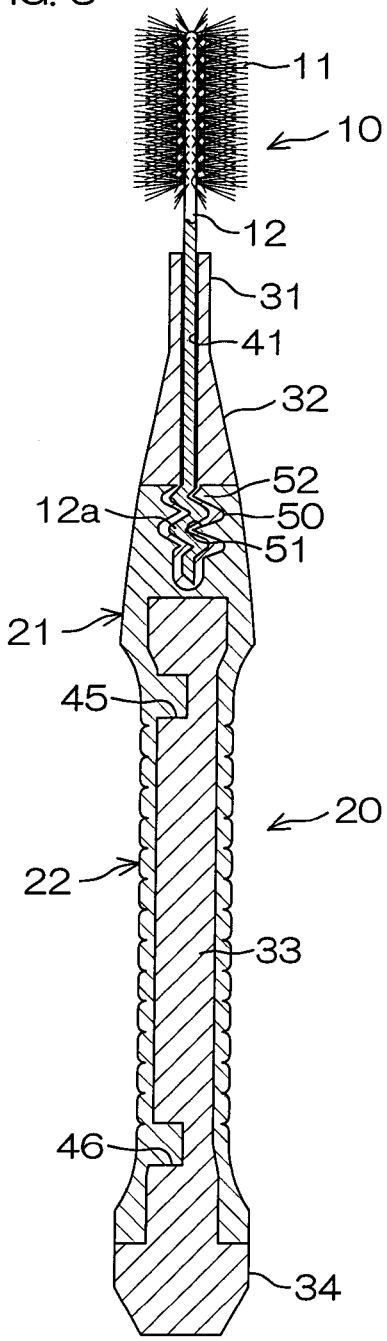
FIG. 3 is a vertical cross-sectional view along the line III-III of FIG. 1.
Figure 4:
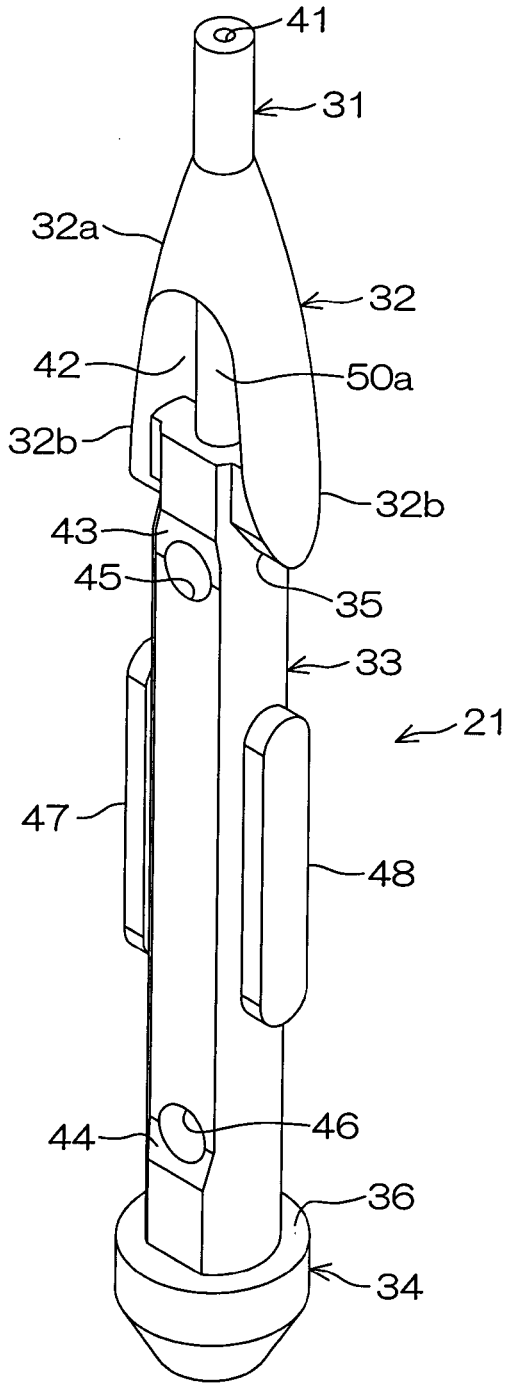
FIG. 4 is a perspective view of a main body in the interdental brush according to the first embodiment of the present invention.
Figure 5:
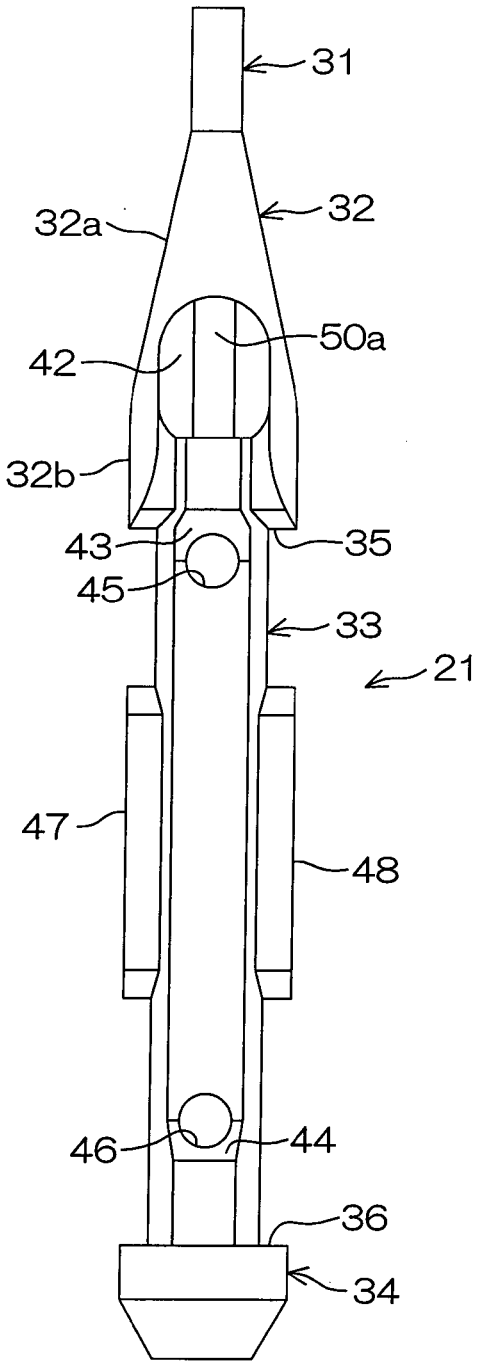
FIG. 5 is a front view of the main body shown in FIG. 4.
Figure 6:
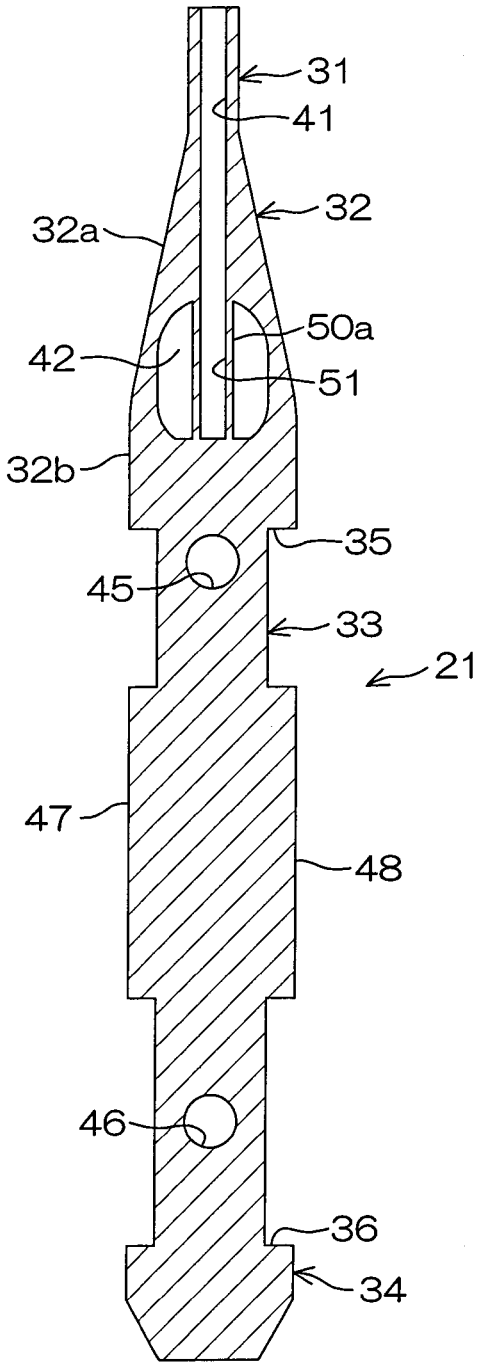
FIG. 6 is a front cross-sectional view of the main body shown in FIG. 4.
Figure 7:
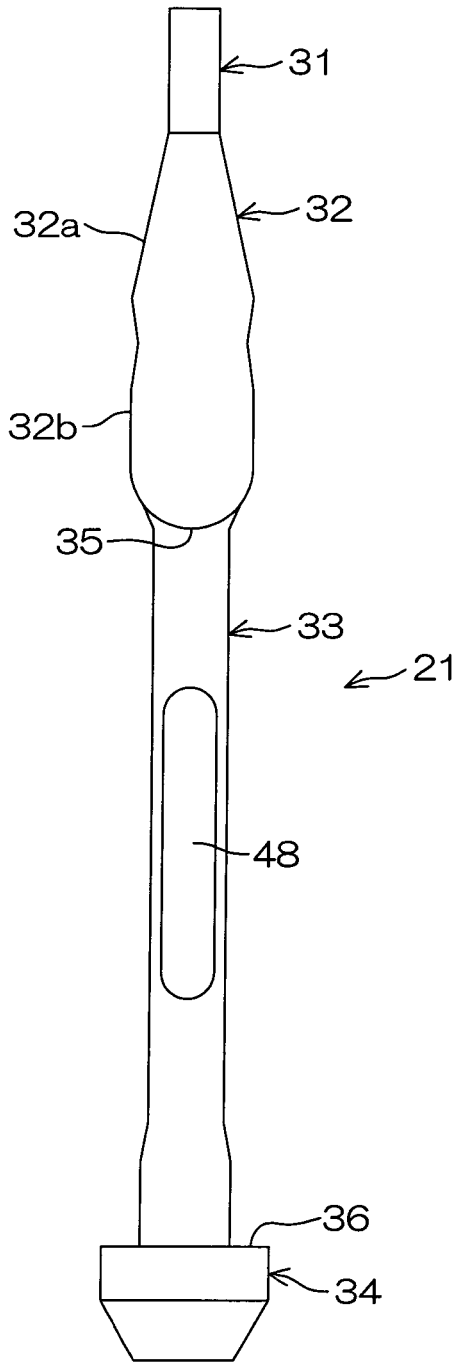
FIG. 7 is a side view of the main body shown in FIG. 4.
Figure 8:
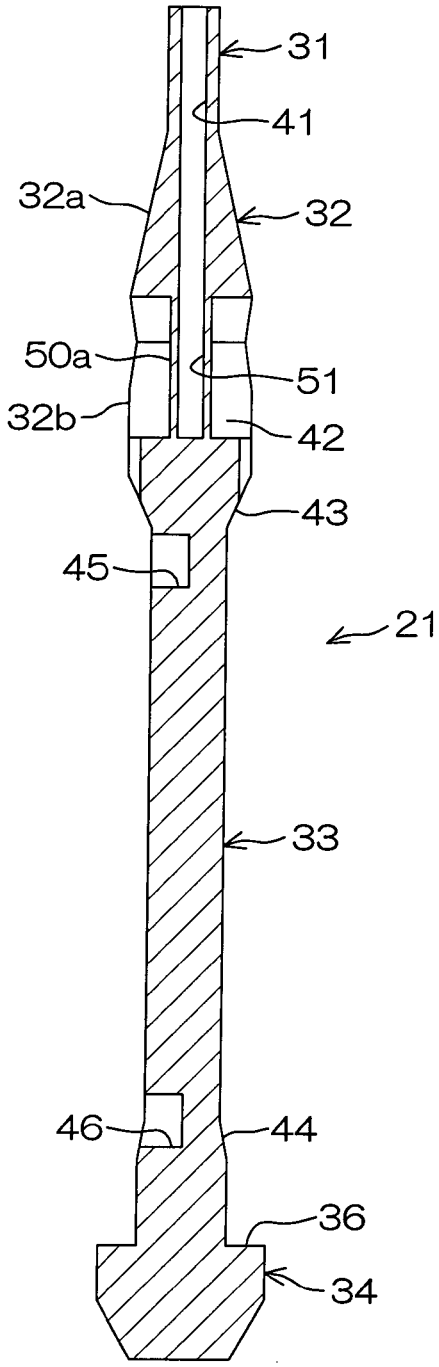
FIG. 8 is a side cross-sectional view of the main body shown in FIG. 4.

Referring to FIGS. 1 to 9, the first embodiment of the present invention is described. FIGS. 1 to 3 show an interdental brush according to the first embodiment of the present invention.

In the following description, it is assumed that, based on FIGS. 1 to 3, the upper and lower sides thereof are respectively described with the wording "upper and lower". It is also assumed that the left and right sides of FIG. 2 are described with the wording "left and right", and the left and right sides of FIG. 3 are described with the wording "front and back".

The interdental brush includes a twisted wire with bristles 10, and a handle 20 made of a thermoplastic synthetic resin. The twisted wire with bristles 10 includes bristles 11 and a stainless steel wire 12. The bristles 11 are divided into a large number of bundles. The bristles 11 are placed in between the half-folded wire 12 on a per bundle basis, and the wire 12 is twisted therewith. In this manner, the twisted wire with bristles 10 is configured which has a distal part provided with the bristles, and a base part without the bristles.

The handle 20 includes a main body 21 and a sub-body 22. The main body 21 and the sub-body 22 are each formed by injection molding of polyethylene. As described later, the main body 21 is formed by primary molding, while the sub-body 22 is formed by secondary molding. Note that, as the materials of the main body 21 and the sub-body 22, there may be used the same material or different materials. For easy holding of the interdental brush, a material more flexible than the material of the main body 21 is preferably used as the material of the sub-body 22 covering substantially the entire surface of a trunk portion 33. Specifically, for example, the main body 21 is made of polyethylene, and the sub-body 22 is made of a synthetic resin having rubbery properties such as EPDM.

FIGS. 4 to 8 show the main body 21 formed by primary molding.

The main body 21 has a linear shape extending in a vertical direction as a whole, and includes a neck portion 31 having a round-rod-like shape, a shoulder portion 32 having a generally reverse-U-shaped shape which downwardly enlarges, the trunk portion 33 having a round-rod-like shape, and a tail portion 34 having a circular truncated cone shape which downwardly tapers. The shoulder portion 32 downwardly enlarges into a conical shape from the lower end of the neck portion 31, and then only the left and right side portions thereof extend to the upper portions of the left and right side surfaces of the trunk portion 33, while downwardly enlarging. The upper portion of the shoulder portion 32 enlarged in the conical shape is referred to as a conical part 32*a*, and the portions of the shoulder portion 32 extending from the conical part 32*a* on both sides thereof, while downwardly enlarging, are referred to as drooping parts 32*b*.

The main body 21 is formed with a longitudinal hole 41 extending from the distal end of the neck portion 31 through the neck portion 31 and the conical part 32*a* of the shoulder portion 32 in a vertical direction (longitudinal direction). The diameter of the longitudinal hole 41 has a dimension which allows the twisted wire with bristles 10 to be loosely inserted through the longitudinal hole 41. Between the shoulder portion 32 and the trunk portion 33, formed is a space section 42 connecting to the longitudinal hole 41, and extending through the main body 21 in a front-to-back direction (lateral direction). In a peripheral portion of an opening of the longitudinal hole 41 at the inner wall surface of the space section 42, formed is a tubular part 50*a* extending in the space section 42, and having a hole 51 communicated to the longitudinal hole 41.

As shown in FIGS. 4 to 6 and 8, the tubular part 50*a* has a linear shape when the main body 21 is formed by primary molding. In the first embodiment, the tip (lower end) of the tubular part 50*a* is connected to the upper end surface of the trunk portion 33. As described later, in the process of producing the interdental brush, the lower end of the tubular part 50*a* is cut away from the trunk portion 33, while the tubular part 50*a* is curved into a generally S-shaped shape. Accordingly, in the interdental brush as a finished product, the tubular part 50*a* becomes a wire detachment preventing portion 50 which is curved in a generally S-shaped shape when viewed in the left-to-right direction, as shown in FIG. 3.

The trunk portion 33 is formed in a shape obtained by scraping flat the front and back sides of a vertically extending round rod. Each of the left and right surfaces of the trunk portion 33 has a widthwise center thereof formed into an outwardly protruding curved surface. On the other hand, each of the front and back surfaces of the trunk portion 33 is formed as a flat surface. The front and back surfaces of the trunk portion 33 have inclined stepped portions 43 and 44 which are formed on the respective boundaries between the upper and lower end portions thereof and the middle portions therebetween to gradually lower in level toward the middle portions. Accordingly, the middle portions between the upper and lower end portions of the front and back surfaces of the trunk portion 33 have respective surfaces thereof formed lower in level than the respective surfaces of the upper and lower end portions of the front and back surfaces of the trunk portion 33. The front surface of the trunk portion 33 has two circular recessed portions 45 and 46 which are formed in spaced-apart relation in the vertical direction. The left and right side surfaces of the trunk portion 33 are respectively formed with rectangular protruding portions 47 and 48 which are elongated in the vertical direction.

On the boundary between each of the drooping parts 32*b* of the shoulder portion 32 and the trunk portion 33, formed is a shoulder-side step 35 lower in level than the shoulder portion 32. The shoulder-side step 35 has a U-shaped shape which is upwardly opened when viewed in the left-to-right direction. On the boundary between the tail portion 34 and the trunk portion 33, formed is an annular tail-side step 36 which is lower in level than the tail portion 34.

Referring back to FIGS. 1 to 3, as described above, the main body 21 is formed with the wire detachment preventing portion 50 having the hole 51 communicated to the longitudinal hole 41, and curved in a generally S-shaped shape when viewed in the left-to-right direction. The base part of the twisted wire with bristles 10 extends through the longitudinal hole 41. The tip portion of the base part of the twisted wire with bristles 10 is inserted in the wire detachment preventing portion 50, and curved in a generally S-shaped shape together with the wire detachment preventing portion 50 when viewed in the left-to-right direction. That is, the tip portion of the base part of the twisted wire with bristles 10 is formed with a curved portion 12*a*.

The sub-body 22 is formed so as to cover the entire surface of the trunk portion 33 except for the outer surfaces of the rectangular protruding portions 47 and 48, and fill the space section 42 and the recessed portions 45 and 46. In the space section 42, the sub-body 22 surrounds the periphery of the wire detachment preventing portion 50, thereby forming an engagement portion 52 with the wire detachment preventing portion 50.

The level difference of each of the shoulder-side step 35 and the tail-side step 36 is eliminated by the sub-body 22. As a result, the boundaries between the respective surfaces of the shoulder portion 32 and the tail portion 34 and the surface of the sub-body 22 adjacent thereto are flush with each other. The outer surfaces of the rectangular protruding portions 47 and 48 are exposed at the surface of the sub-body 22. In this embodiment, to reduce the slipperiness of the handle 20 when it is held by a user, a plurality of grooves are formed in vertically spaced-apart relation in the surface of the sub-body 22 formed around the longitudinal middle portion of the trunk portion 33 of the main body 21.

The colors of the resins forming the main body 21 and the sub-body 22 are different from each other. For example, when blue is adopted as the color of the main body 21, and white is adopted as the color of the sub-body 22, it follows that the handle 20 is colored in two tones which give an impression of cleanliness.

Figure 9:
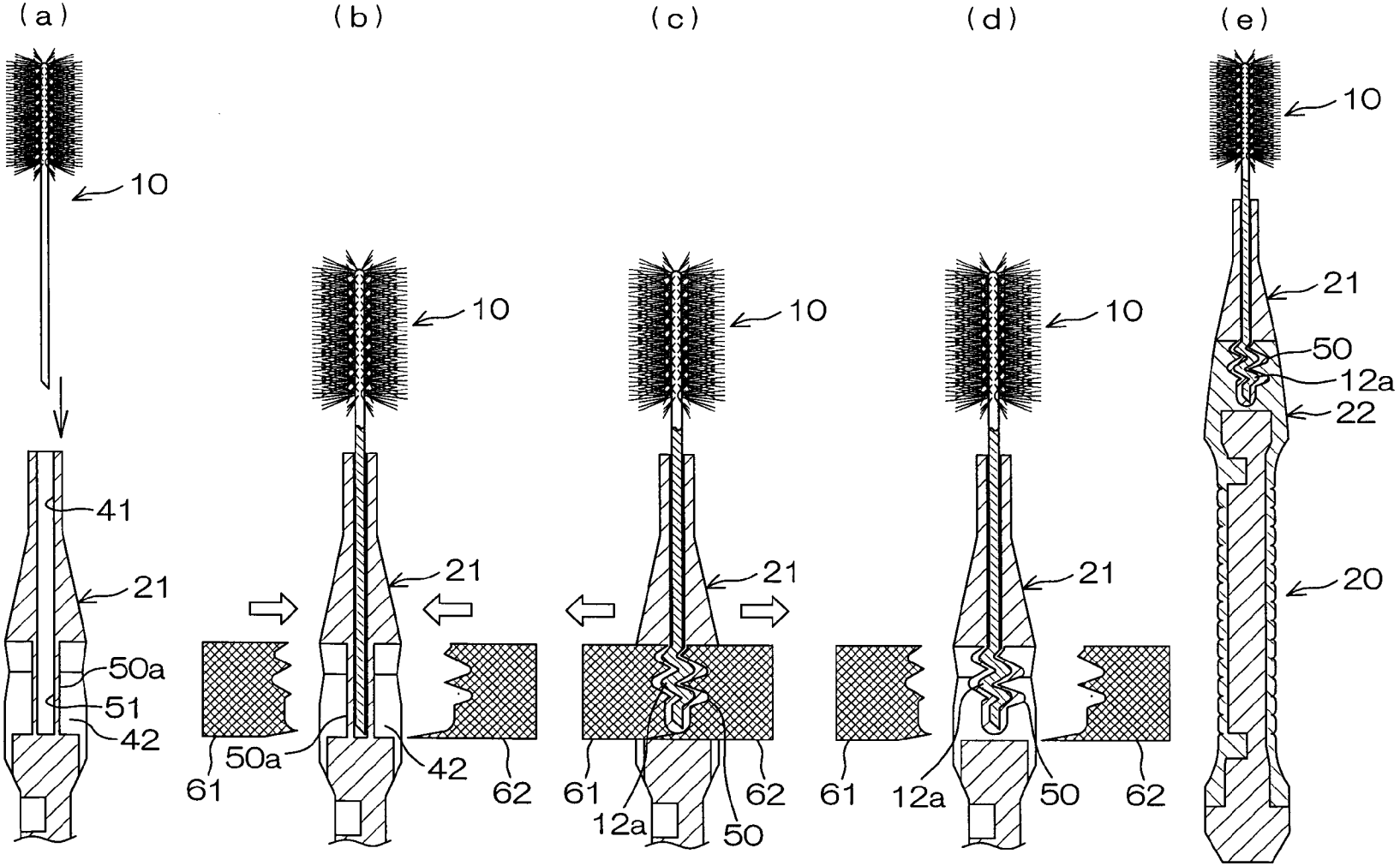
FIGS. 9(*a*)-(*e*) are production process views of the interdental brush shown in FIG. 1.

Next, a method of producing the interdental brush is described with reference to FIG. 9. First, the main body 21 is formed by primary molding. As a result, the main body 21 shown in FIGS. 4 to 8 is obtained. As described above, when the main body 21 is molded, not the wire detachment preventing portion 50 curved in a generally S-shaped shape, but the tubular part 50*a* having a linear shape is formed.

Next, the base part of the twisted wire with bristles 10 is inserted through the longitudinal hole 41, and the tip portion of the base part of the twisted wire with bristles 10 is inserted into the tubular part 50*a*. Thereafter, jigs 61 and 62 are inserted into the space section 42 from both sides (front and back sides) thereof. One of the opposing surfaces of these jigs 61 and 62 is formed with a blade for cutting away the lower end of the tubular part 50*a* from the trunk portion 33, while the other opposing surface is formed with a notch for receiving the blade. The opposing surfaces of these jigs 61 and 62 are also formed with depressions and projections for curing the tubular part 50*a* into a generally S-shaped shape.

When the jigs 61 and 62 are inserted into the space section 42 from both sides thereof, the lower end of the tubular part 50*a* is first cut by the blade formed in the one jig 62 to be separated from the trunk portion 33. Thereafter, the jigs 61 are 62 are further inserted to press the tubular part 50*a* from both sides thereof. As a result, by the depressions and projections formed in the opposing surfaces of the both jigs 61 and 62, the tubular part 50*a* is deformed into a generally S-shaped shape to form the wire detachment preventing portion 50. Note that the tip portion of the base part of the twisted wire with bristles 10 is also deformed into a generally S-shaped shape to form the curved portion 12*a*. At this time, the jigs 61 and 62 may also be heated appropriately to simultaneously heat the tubular part 50*a* upon pressing the tubular part 50*a*. The pressing is effected with a pressing machine.

Then, after the jigs 61 and 62 are retracted, the sub-body 22 is formed by secondary molding. The main body 21 and the sub-body 22 are fixedly attached to each other so that there is no concern of detachment.

The interdental brush according to the first embodiment can be produced by simple resin molding without using insert resin molding. Accordingly, an inexpensive interdental brush is provided. Additionally, in the interdental brush according to the first embodiment, the wire detachment preventing portion 50 in which the base part of the twisted wire with bristles 10 is inserted, and which is curved into a generally S-shaped shape together with the twisted wire with bristles 10 is formed in the main body 21. As a result, the twisted wire with bristles 10 is less likely to come off the longitudinal hole 41 formed in the main body 21. As compared to the case where the main body 21 does not have the wire detachment preventing portion 50, and only the tip portion of the base part of the twisted wire with bristles 10 is curved, the twisted wire with bristles 10 is less likely to rotate in the longitudinal hole 41 in the interdental brush according to the first embodiment. In addition, when the twisted wire with bristles 10 is pulled, the twisted wire with bristles 10 is less likely to be straightened into a linear shape. Therefore, the twisted wire with bristles 10 is less likely to come off the longitudinal hole 41.

Moreover, in the interdental brush according to the first embodiment, the engagement portion 52 surrounding the periphery of the wire detachment preventing portion 50 is formed by the sub-body 22. As a result, the twisted wire with bristles 10 is less likely to rotate in the longitudinal hole 41 and, when the twisted wire with bristles 10 is pulled, the twisted wire with bristles 10 is less likely to be straightened into a linear shape. Therefore, the twisted wire with bristles 10 is less likely to come off the longitudinal hole 41.

To allow easy holding of the interdental brush, it is preferable to use a material more flexible than the material of the main body 21 as the material of the sub-body 22 covering substantially the entire surface of the trunk portion 33. For example, the main body 21 is made of polyethylene, and the sub-body 22 is made of a synthetic resin having rubbery properties such as EPDM. In such a case also, the wire detachment preventing portion 50 curved in a generally S-shaped shape is formed of a relatively hard material (material harder than the sub-body 22). Therefore, when the twisted wire with bristles 10 is pulled, the twisted wire with bristles 10 is less likely to be straightened into a linear shape, and less likely to come off the longitudinal hole 41.

In the interdental brush according to the first embodiment, the main body 21 obtained by primary molding is formed with the tubular part 50*a*, as shown in FIGS. 4 to 6 and 8. Then, with the tip portion of the base part of the twisted wire with bristles 10 being inserted in the tubular part 50*a*, the tubular part 50*a* is pressed from both sides thereof with the jigs 61 and 62, and thereby curved together with the twisted wire with bristles 10. Thus, the main body 21 obtained by primary molding is formed with the tubular part 50*a* into which the tip portion of the base part of the twisted wire with bristles 10 is inserted, and which is curved together with the twisted wire with bristles 10. As a result, it is possible to position the twisted wire with bristles 10 at an optimum position for pressing with the jigs. This allows the twisted wire with bristles 10 and the tubular part 50*a* to be pressed at the optimum position for pressing. This also allows easy automatization of the step of curving the tubular part 50*a* using the jigs, and forming the tubular part 50*a* into the wire detachment preventing portion 50.

(2) Embodiment 2

Figure 10:
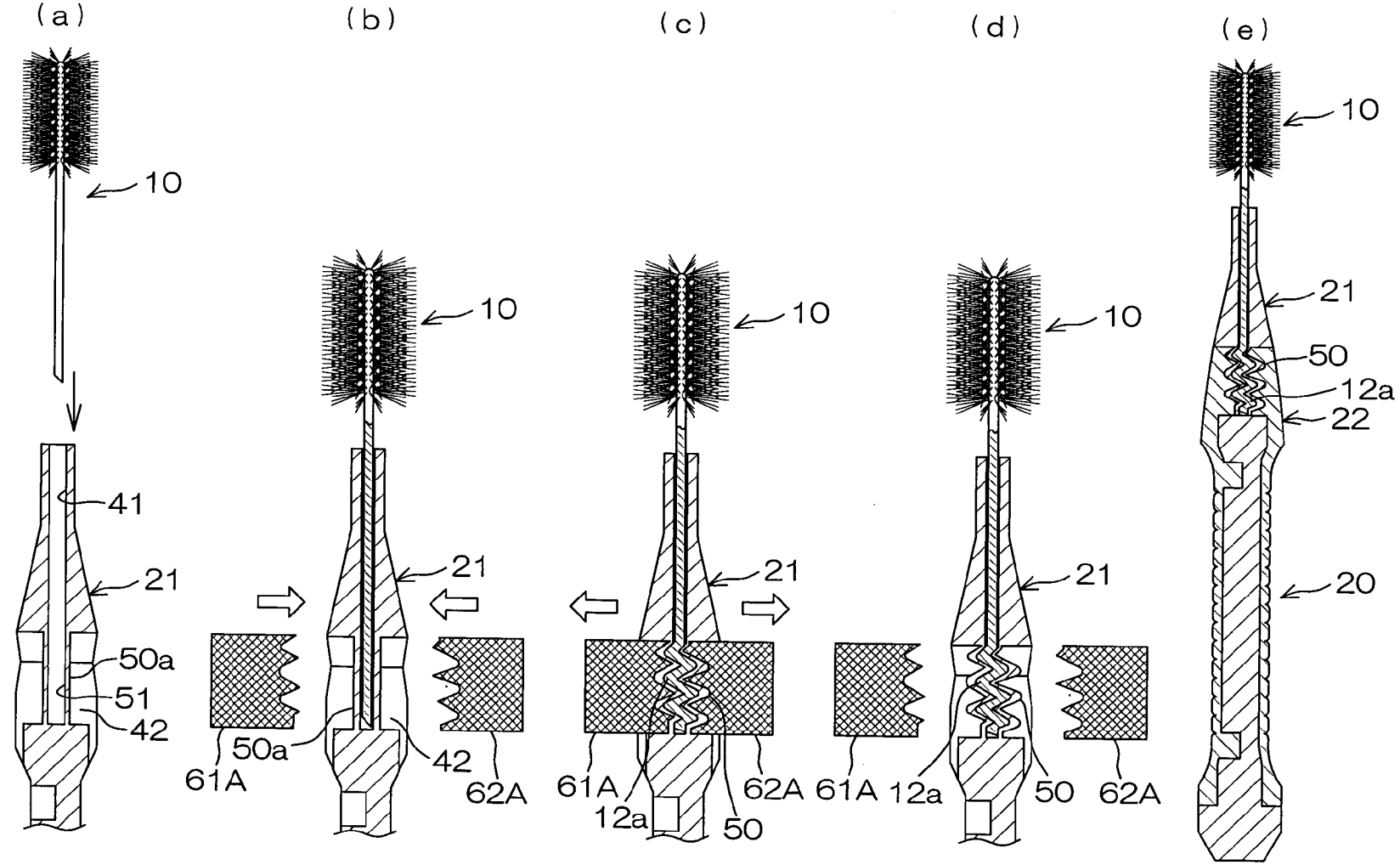
FIGS. 10(*a*)-(*e*) are production process views of an interdental brush according to a second embodiment of the present invention.

Referring to FIG. 10, the second embodiment of the present invention is described. Compared with the interdental brush according to the first embodiment, the interdental brush according to the second embodiment is different therefrom in terms of a method of curving the tubular part 50*a* into a generally S-shaped shape. Specifically, in the second embodiment, jigs used to curve the tubular part 50*a* into a generally S-shaped shape are different from the jigs used in the first embodiment. The second embodiment is otherwise the same as the first embodiment.

FIG. 10 shows a method of producing the interdental brush as the second embodiment of the present invention. First, the same main body 21 as that of the first embodiment 21 is formed by primary molding. As a result, the main body 21 shown in FIGS. 4 to 8 is obtained. When the main body 21 is molded, not the wire detachment preventing portion 50 curved into a generally S-shaped shape, but the tubular part 50*a* having a linear shape is formed. The lower end of the tubular part 50*a* is connected to the upper surface of the trunk portion 33.

Next, the base part of the twisted wire with bristles 10 is inserted through the longitudinal hole 41, and the tip portion of the base part of the twisted wire with bristles 10 is inserted into the tubular part 50*a*. Thereafter, jigs 61A and 62A are inserted into the space section 42 from both sides (front and back sides) thereof. The opposing surfaces of these jigs 61A and 62A are formed with depressions and projections for curving the tubular part 50*a* into a generally S-shaped shape but, unlike the jigs 61 and 62 used in the first embodiment, neither of the jigs 61A and 62A is formed with a blade for cutting away the lower end of the tubular part 50*a* from the trunk portion 33.

The jigs 61A and 62A are inserted into the space section 42 from both sides thereof to press the tubular part 50*a* from both sides thereof. As a result, by the depressions and projections formed in the opposing surfaces of the both jigs 61A and 62A, the tubular part 50*a* is deformed into a generally S-shaped shape with the lower end thereof being connected to the upper surface of the trunk portion 33 to form the wire detachment preventing portion 50. That is, the tubular part 50*a* is elongated by the ductility thereof, and deformed. Note that the tip portion of the base part of the twisted wire with bristles 10 is also deformed into a generally S-shaped shape to form the curved portion 12*a*. At this time, the jigs 61A and 62A may also be heated appropriately to simultaneously heat the tubular part 50*a* upon pressing the tubular part 50*a*. The pressing is effected with a pressing machine.

Then, after the jigs 61A and 62A are retracted, the sub-body 22 is formed by secondary molding. In the second embodiment also, the same effects as obtained in the first embodiment described above are obtainable.

(3) Embodiment 3

Figure 11:
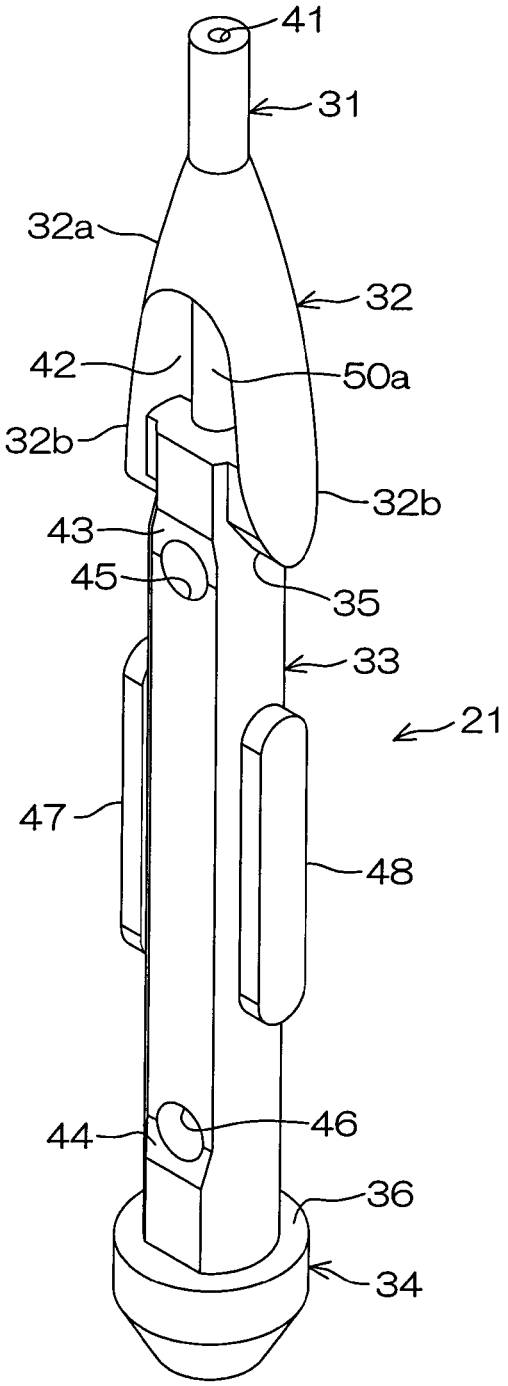
FIG. 11 is a perspective view of a main body in an interdental brush according to a third embodiment of the present invention.
Figure 12:
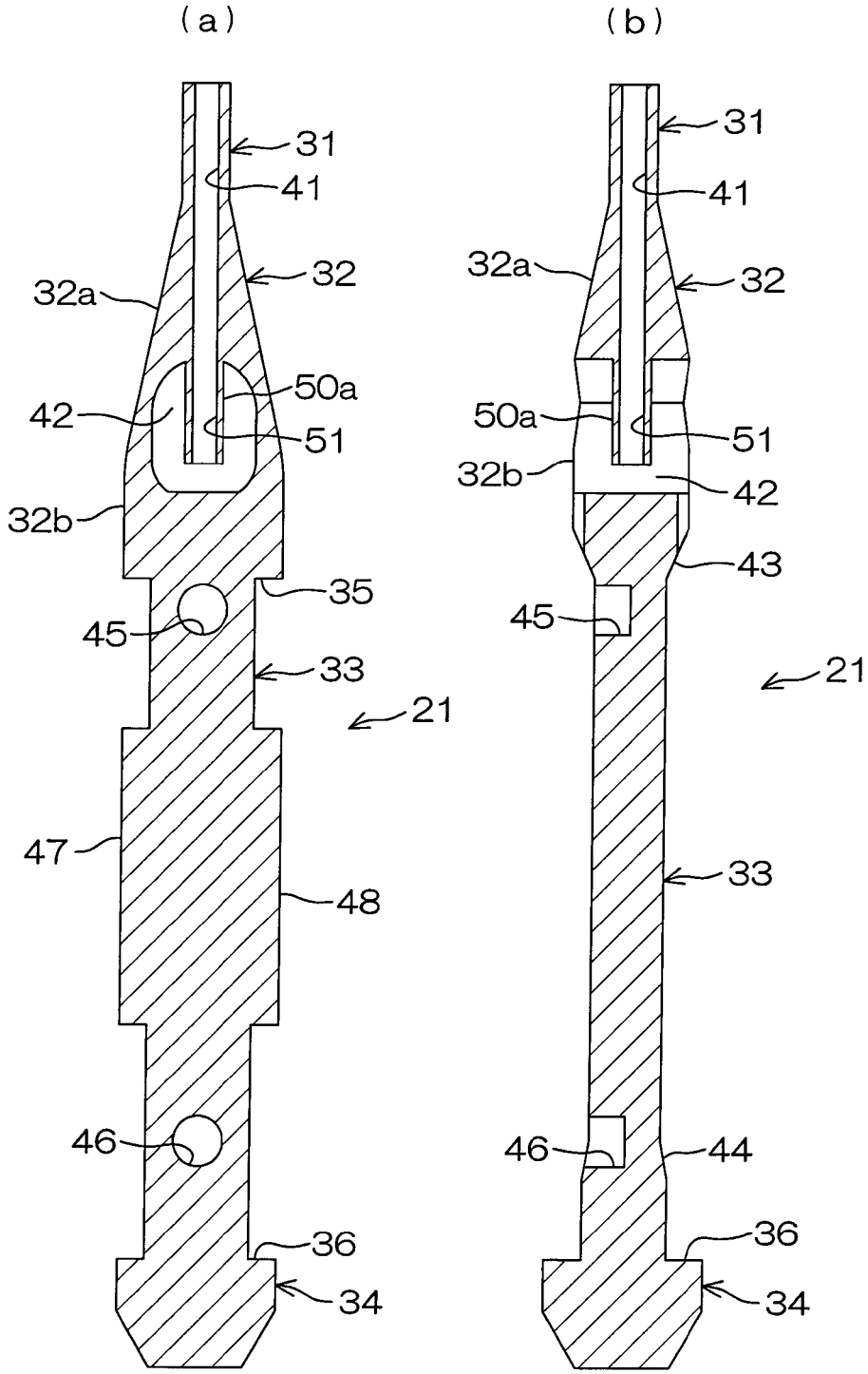
FIGS. 12(*a*)-(*b*) are a front cross-sectional view and a side cross-sectional view of the main body shown in FIG. 11.
Figure 13:
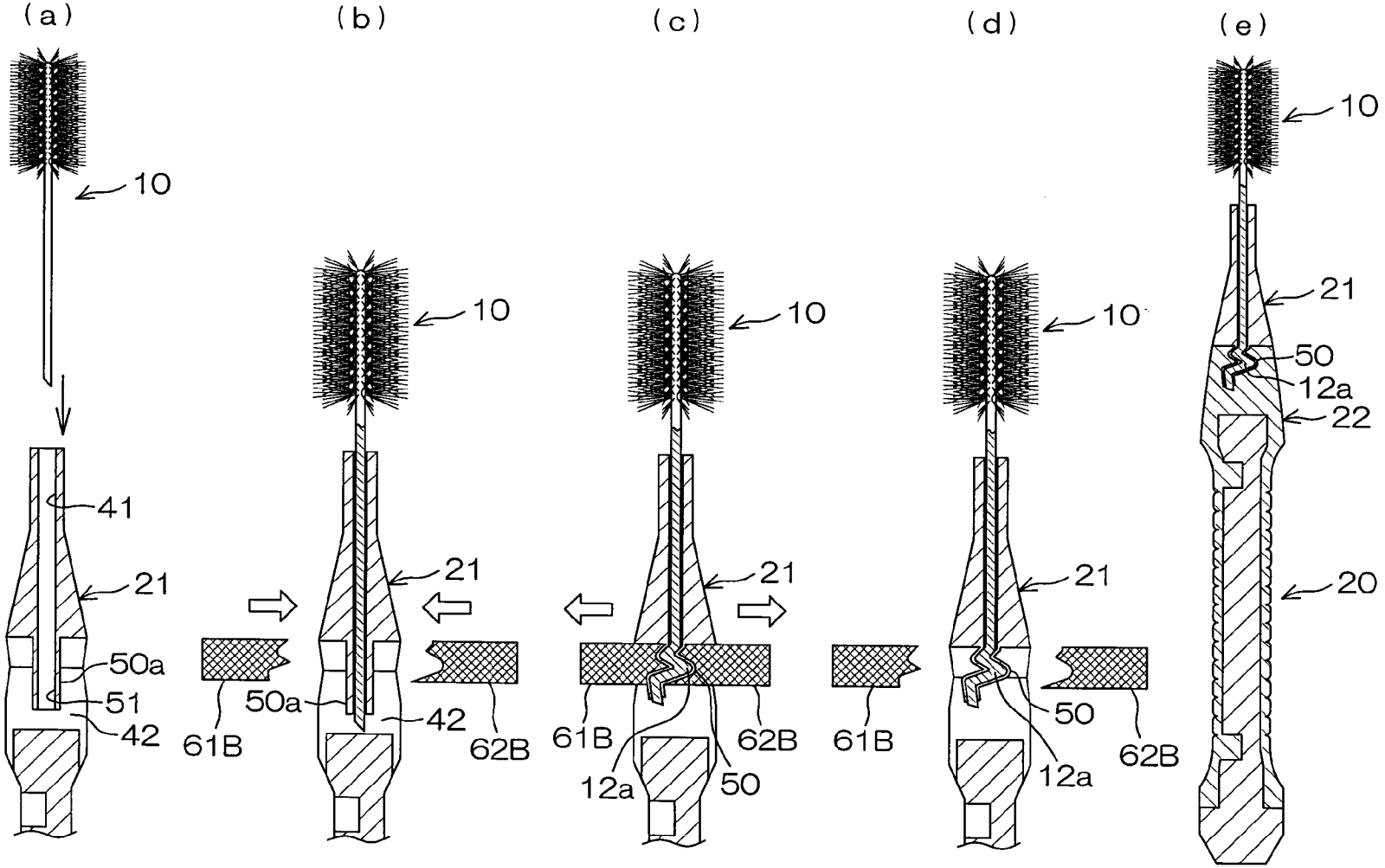
FIGS. 13(*a*)-(*e*) are production process views of the interdental brush according to the third embodiment of the present invention.

Referring to FIGS. 11 to 13, the third embodiment of the present invention is described. Compared with the interdental brush according to the first embodiment, the interdental brush according to the third embodiment is different therefrom in terms of the tubular part 50*a* in the main body 21 produced by primary molding. More specifically, in the main body 21 in the third embodiment, the tubular part 50*a* is formed shorter than that of the first embodiment, and the lower end of the tubular part 50*a* is not connected to the trunk portion 33, as shown in FIGS. 11 and 12. In addition, jigs used to curve the tubular part 50*a* into a generally S-shaped shape are different from the jigs used in the first embodiment. The third embodiment is otherwise the same as the first embodiment.

FIG. 13 shows a method of producing the interdental brush as the third embodiment of the present invention. First, the main body 21 shown in FIGS. 11 and 12 is produced by primary molding. When the main body 21 is molded, not the wire detachment preventing portion 50 curved into a generally S-shaped shape, but the tubular part 50*a* having a linear shape is formed. The lower end of the tubular part 50*a* extends in the space section 42, but does not reach the trunk portion 33. That is, the lower end of the tubular part 50*a* is not connected to the trunk portion 33.

Then, the base part of the twisted wire with bristles 10 is inserted through the longitudinal hole 41, and the tip portion of the base part of the twisted wire with bristles 10 is inserted into (inserted through) the tubular part 50*a*. Thereafter, jigs 61B and 62B are inserted into the space section 42 from both sides (front and back sides) thereof. The opposing surfaces of the jigs 61B and 62B are formed with depressions and projections for curving the tubular part 50*a* into a generally S-shaped shape.

The jigs 61B and 62B are inserted into the space section 42 from both sides thereof to press the tubular part 50*a* from both sides thereof. Then, by the depressions and projections formed in the opposing surfaces of the both jigs 61B and 62B, the tubular part 50*a* is deformed into a generally S-shaped shape to form the wire detachment preventing portion 50. Note that the tip portion of the based part of the twisted wire with bristles 10 is also deformed into a generally S-shaped shape to form the curved portion 12*a*. At this time, the jigs 61B and 62B may also be heated appropriately to simultaneously heat the tubular part 50*a* upon pressing the tubular part 50*a*. The pressing is effected with a pressing machine.

Then, after the jigs 61B and 62B are retracted, the sub-body 22 is formed by secondary molding. In the third embodiment also, the same effects as obtained in the first embodiment described above are obtainable.

While the embodiments of the present invention have been described in detail, they are only specific examples used to clarify the technical content of the present invention. The present invention should not be construed to be limited to these specific examples, and the spirit and scope of the present invention is limited only by appended claims.

The present application corresponds to Japanese Application No. 2009-158052 filed on Jul. 2, 2009, the contents of which are herein incorporated by reference in their entirety.

EXPLANATION OF LETTERS AND NUMERALS

11 Bristle
12 Wire
20 Handle
21 Main Body
41 Longitudinal Hole
42 Space Section
50 Wire Detachment Preventing Portion

The invention claimed is:

1. An interdental brush comprising:
bristles (11);
a wire (12) twisted with the bristles (11); and
a handle (20) attached to the wire (12),
the handle (20) including a main body (21),
wherein
the main body (21) is formed with a longitudinal hole (41) through which a base part of the wire (12) extends, a space section (42) connecting to the longitudinal hole (41), and extending through the main body (21) in a lateral direction, and a tubular wire detachment preventing portion (50) extending from a peripheral portion of an opening of the longitudinal hole (41) at an inner wall surface of the space section (42) into the space section (42), and
the wire detachment preventing portion (50) is curved together with the wire (12) with a tip portion of the base part of the wire (12) being inserted therein.

2. The interdental brush according to claim 1, wherein the space section (42) is filled with a filler member (22), and the filler member (22) forms an engagement portion (52) surrounding the periphery of the wire detachment preventing portion (50).

3. The interdental brush according to claim 2, wherein the handle (20) includes the main body (21) and a sub-body (22), and the sub-body (22) includes an engagement portion (52) filling the space section (42) so as to surround the periphery of the wire detachment preventing portion (50).

4. The interdental brush according to claim 3, wherein a part of a surface of the main body (21) is covered with the sub-body (22), and the main body (21) and the sub-body (22) have respective discrimination properties different from each other.

5. The interdental brush according to claim 3, wherein the main body (21) and the sub-body (22) are each made of a synthetic resin.

6. The interdental brush according to claim 4, wherein the difference between the discrimination properties results from at least any one of color, gloss, and material.

7. The interdental brush according to any one of claims 3 to 6, wherein
the main body (21) includes a shoulder portion (32), a tail portion (34), and a trunk portion (33) communicating the shoulder portion (32) to the tail portion (34) via a step at a low level,
the space section (42) is formed between the shoulder portion (32) and the trunk portion (33),
the sub-body (22) fills the space section (42), and covers the trunk portion (33), and
the boundaries between respective surfaces of the shoulder portion (32) and the tail portion (34) and a surface of the sub-body (22) adjacent thereto are flush with each other.

8. A method of producing an interdental brush comprising a wire (12) twisted with bristles (11), and a handle (20) attached to the wire (12), the handle (20) including a main body (21), the method comprising the steps of:
resin molding the main body (21) including a longitudinal hole (41), a space section (42) connecting to the longitudinal hole (41), and extending through the main body (21) in a lateral direction, and a tubular part (50*a*) extending from a peripheral portion of an opening of the longitudinal hole (41) at an inner wall surface of the space section (42) into the space section (42); and
inserting a tip portion of a base part of the wire (12) into the tubular part (50*a*) through the longitudinal hole (41) of the main body (21), and curving the tubular part (50*a*) together with the wire (12) with the tip portion of the base part of the wire (12) being inserted in the tubular part (50*a*) to form a wire detachment preventing portion (50) in the main body (21).

9. The method of producing the interdental brush according to claim 8, further comprising the step of:

resin molding a sub-body (22) of the handle (20) so as to cause a part of the sub-body (22) to surround the periphery of the wire detachment preventing portion (50), and fill the space section (42).

10. The method of producing the interdental brush according to claim 8 or 9, wherein the formation of the wire detachment preventing portion (50) is performed by pressing, using two jigs, the tubular part (50*a*) in which the base part of the wire (12) is inserted from both sides thereof in a nipping manner through the space section (42).

* * * * *

UNITED STATES PATENT AND TRADEMARK OFFICE

CERTIFICATE OF CORRECTION

PATENT NO. : 8,567,000 B2
APPLICATION NO. : 13/255173
DATED : October 29, 2013
INVENTOR(S) : Yosuke Kubo It is certified that error appears in the above-identified patent and that said Letters Patent is hereby corrected as shown below:

In the Claims

<u>In Claim 3, Column 10, Line 20:</u>
Change

"Claim 2"

to be

--Claim 1--

Signed and Sealed this
Twenty-fifth Day of March, 2014

Michelle K. Lee

Michelle K. Lee
*Deputy Director of the United States Patent and Trademark Office*